US009744557B2

(12) United States Patent
Dellea et al.

(10) Patent No.: US 9,744,557 B2
(45) Date of Patent: Aug. 29, 2017

(54) METHOD FOR FORMING A FILM OF PARTICLES ON A CARRIER LIQUID, WITH MOVEMENT OF AN INCLINED RAMP FOR COMPRESSING THE PARTICLES

(71) Applicant: COMMISSARIAT À L'ÉNERGIE ATOMIQUE ET AUX ÉNERGIES ALTERNATIVES, Paris (FR)

(72) Inventors: Olivier Dellea, La Talaudiere (FR); Philippe Coronel, Barraux (FR); Pascal Fugier, Bernin (FR)

(73) Assignee: Commissariat à l'énergie atomique et aux énergies alternative, Paris (FR)

( * ) Notice: Subject to any disclaimer, the term of this patent is extended or adjusted under 35 U.S.C. 154(b) by 83 days.

(21) Appl. No.: 14/423,957

(22) PCT Filed: Sep. 9, 2013

(86) PCT No.: PCT/EP2013/068593
§ 371 (c)(1),
(2) Date: Feb. 25, 2015

(87) PCT Pub. No.: WO2014/037559
PCT Pub. Date: Mar. 13, 2014

(65) Prior Publication Data

US 2015/0217328 A1 Aug. 6, 2015

(30) Foreign Application Priority Data

Sep. 10, 2012 (FR) ..... 12 58473

(51) Int. Cl.
*B05D 1/28* (2006.01)
*B05D 1/20* (2006.01)
(Continued)

(52) U.S. Cl.
CPC ..... *B05D 1/28* (2013.01); *B05C 19/008* (2013.01); *B05C 19/04* (2013.01); *B05D 1/20* (2013.01);
(Continued)

(58) Field of Classification Search
None
See application file for complete search history.

(56) References Cited

U.S. PATENT DOCUMENTS 4,801,476 A 1/1989 Dunsmuir et al.
7,804,134 B2 9/2010 Coronel et al.
(Continued)

FOREIGN PATENT DOCUMENTS

EP 0 270 212 6/1988
WO 03 095108 11/2003
(Continued)

OTHER PUBLICATIONS

Foreign Preliminary Search Report Issued Jul. 10, 2013 in French Patent Application No. 12 58473 Filed Sep. 10, 2012.
(Continued)

*Primary Examiner* — Michael P Rodriguez
(74) *Attorney, Agent, or Firm* — Oblon, McClelland, Maier & Neustadt, L.L.P.

(57) ABSTRACT

A method for forming a film of particles on a carrier liquid present in a receptacle, for depositing this film onto a substrate, the method including: making a film blank between a barrier and a head including a tilted ramp, the blank being obtained by dispensing particles via the tilted ramp and carried out until the particles floating on the carrier liquid occupy a space between the barrier and an upstream front of particles located on the tilted ramp; and elongating the film by continuing dispensing the particles, and moving
(Continued)

the head to move away from the barrier, the film elongation being performed to hold a front of particles on the ramp.

15 Claims, 4 Drawing Sheets

(51) Int. Cl.
*B05C 19/00* (2006.01)
*B05C 19/04* (2006.01)

(52) U.S. Cl.
CPC ..... *B05D 2252/00* (2013.01); *B05D 2401/32* (2013.01)

(56) References Cited

U.S. PATENT DOCUMENTS

2005/0129867 A1* 6/2005 Picard ..... B01D 69/122 427/434.3
2005/0281944 A1 12/2005 Jang
2011/0135834 A1 6/2011 Schneider et al.
2013/0052552 A1 2/2013 Phan et al.
2013/0330471 A1 12/2013 Dellea et al.
2014/0147583 A1 5/2014 Dellea et al.
2014/0158334 A1 6/2014 Dellea et al.
2014/0356528 A1 12/2014 Dellea et al.
2014/0374930 A1 12/2014 Dellea et al.
2015/0010693 A1 1/2015 Dellea et al.
2015/0044809 A1 2/2015 Dellea et al.

FOREIGN PATENT DOCUMENTS

WO 2008 014604 2/2008
WO 2012 113745 8/2012

OTHER PUBLICATIONS

International Search Report Issued Feb. 13, 2014 in PCT/EP2013/068593 Filed Sep. 9, 2013.
U.S. Appl. No. 14/232,092, filed Apr. 3, 2014, Savelli, et al.

* cited by examiner

METHOD FOR FORMING A FILM OF PARTICLES ON A CARRIER LIQUID, WITH MOVEMENT OF AN INCLINED RAMP FOR COMPRESSING THE PARTICLES

TECHNICAL FIELD

The invention relates to the field of methods and facilities for depositing particles onto a substrate.

More precisely, it relates to the deposition of a film of ordered particles, preferably of the single layer type, whose particle size can be between a few nanometres and a few hundreds micrometres. Particles, preferably of a spherical shape, can for example be silica particles.

The invention substantially relates to a step of forming the film of ordered particles to be deposited, this step being also called structuring the film of particles, in particular when the film comprises different particles, in terms of dimensions and/or materials.

The invention finds applications in numerous fields such as fuel cells, optics, photonics, polymer coating, chips, MEMs, organic and photovoltaic electronics, heat exchangers, sensors, tribology, etc.

STATE OF PRIOR ART

Numerous techniques are known for depositing films of particles onto a substrate.

The most known technique is the so-called Langmuir-Blodgett technique, consisting in dispensing particles onto a carrier liquid placed in a receptacle, and then compressing these particles in order to order/compact them on the carrier liquid, in order to obtain an ordered/compact film. The compression is performed between the partially vertically submerged substrate, and a vertical compressing barrier opposite the substrate, capable of being moved to decrease the area occupied by the particles. When the compact film is formed, the substrate is moved as well as the compressing barrier, in order to gradually deposit, by capillarity, the film on this substrate. The barrier thus accompanies the pulling movement, in order to keep the ordering of the particles within the film.

Another technique, called the Langmuir-Schaefer technique, enables the film to be deposited on a horizontal substrate. With this technique, the ordering of the film is performed analogously to that of the Langmuir-Blodgett technique, by compressing the particles between two abutments, at least one of which is moveable. Then, the deposition is performed by horizontally bringing the substrate from the outside, or by horizontally raising the substrate previously submerged in the carrier liquid.

Both of these techniques reach their limits upon making large areas. Indeed, when a large amount of particles is dispensed onto the carrier liquid in order to form a large area, for example in the order of 100 $cm^2$ or higher, the simultaneous compression of all the particles performed by the barrier at the surface of the carrier liquid can turn out to be problematic, with risks associated with local defects and/or a lack of evenness, like ball superimpositions, or conversely, the presence of voids in the film.

Besides, these techniques also come up against the impossibility to form films with controlled gradients of particles, such as gradients of materials and/or dimensions. The formation of so-called heterogeneous films turns out to be impossible, since the compression method, by moving the barrier, makes positioning of the particles with respect to each other in the ordered film obtained totally uncertain.

A solution has been provided aiming at solving the problems of deposition on great dimensions, and that of the controlled formation of heterogeneous films. Such a solution is for example known from document WO-A-200814604, basically consisting in forming a film in a transfer zone, which opens onto a displacing substrate. The dispensing of particles is performed continuously on a tilted ramp such that they remain permanently ordered/compacted between an upstream front of particles located on the ramp, and the displacing substrate. With this technique, when new particles are dispensed on the ramp, they directly reach the upstream front on which they assume an ordering, which is kept until the deposition on the substrate. This technique can be implemented with a displacing oblique or vertical substrate, but not with a horizontal substrate. Besides, this technique also suffers from a significant problem in case of a defect occurring upon ordering the particles in the transfer zone. Indeed, unlike the Langmuir-Schaefer and Langmuir-Blodgett techniques wherein the film is fully made before being deposited onto the substrate, the technique described in document WO-A-200814604 simultaneously performs the deposition onto the substrate of part of the film, and the ordering in the transfer zone of a more upstream part of the same film. Consequently, in case of a defect occurring upon ordering in the transfer zone, the latter must be cleared of its particles and the pulling must be stopped, before new ordered particles come to cover the transfer zone and the pulling is started again. However, resuming the pulling under such conditions gives rise to problems, and may not guarantee the quality level required. Besides, if a transition zone between particles having different natures is located in the transfer zone at the time of the defect, it can turn out to be difficult, even impossible, to reproduce in a controlled manner this gradient with new particles introduced in the transfer zone.

DISCLOSURE OF THE INVENTION

Thus, one purpose of the present invention is to overcome at least partly the aforementioned drawbacks, relating to embodiments of prior art.

For this, one object of the invention is first to provide a method for forming a film of particles on a carrier liquid present in a receptacle, for depositing this film onto a substrate, characterized in that it comprises the following successive steps of:

- making a film blank between barrier means and a head having a tilted ramp, said blank being obtained by dispensing particles via said tilted ramp, carried out until these particles floating on the carrier liquid occupy the space between the barrier means against which they abut, and an upstream front of particles located on the tilted ramp; and
- elongating the film while simultaneously continuing dispensing the particles via said tilted ramp, and moving said head relative to the receptacle so as to move this head away from said barrier means, this film elongation being performed so as to hold said upstream front of particles on the tilted ramp.

Another object of the invention is also to provide a facility for depositing a film of particles onto a substrate, the facility comprising a receptacle for receiving a carrier liquid on which said film is intended to be formed, characterized in that it further comprises a head having a tilted ramp through which the particles are intended to pass before reaching the carrier liquid of the receptacle, and in that it comprises means for moving said head relative to the receptacle, in parallel to the surface of said carrier liquid.

The invention is remarkable in that it enables, substantially by virtue of the movement of the tilted ramp during the formation of the film, a film having a great length to be formed while restricting the defect risks within the same. Indeed, the film is gradually directly formed on the ramp at the upstream front of the particles, before being deposited onto the carrier liquid of the receptacle as the head moves back. This solution strongly contrasts with conventional solutions of prior art based on the Langmuir-Schaefer and Langmuir-Blodgett techniques, wherein all the particles are placed on the carrier liquid before being all simultaneously compressed by the barrier therefor.

Besides, the invention enables the entire film to be formed on the carrier liquid before being deposited onto the substrate, thus avoiding the risks related to the possible pulling resumptions in case of a defect in ordering, as can be experienced with the transfer zone technique described in document WO-A-200814604. It is however the particle compression technique by a tilted ramp disclosed in this document which is adopted by the present invention, because during the film formation, at least part of the energy necessary for ordering/compacting the particles is fed by the tilted ramp conveying the carrier liquid and these particles.

Further, the controlled formation of heterogeneous films is perfectly worth considering with the invention, since when new particles pass through the ramp, they directly reach the upstream front on which they assume an ordering/compacting which is kept during the entire film formation, up to the deposition onto the substrate. To obtain a heterogeneous film, it is simply sufficient to dispense in turn particles of different natures, which are located in the film with an order corresponding to that wherein they have been dispensed.

Finally, the invention provides the advantage of being applicable to any kind of depositions, on a rigid or flexible substrate, horizontally, vertically or obliquely, by capillarity and/or direct contact, etc. Besides, the substrate can be planar or in three dimensions.

Preferably, during the film elongation step, said upstream front of particles is held in a same position on the ramp. This contributes to obtaining constant film formation conditions, regardless of the position of the head during this formation. For the same purpose, it is preferential that said head has sucking means for sucking part of the carrier liquid in the proximity of a submerged end of said tilted ramp, said means being activated at least during part of said step of elongating the film, and preferably constantly activated during the entire elongation step. Preferentially, the liquid circulation is active during the film formation, but it is preferable to stop it during a subsequent transfer of the film onto the substrate.

Preferably, carrier liquid feed means supply said head with the carrier liquid such that the same drives said particles onto the tilted ramp. Thus, by controlling the supply and sucking of carrier liquid, it is easy to achieve constant film formation conditions. More precisely, by controlling both these supply and sucking parameters, it is possible to achieve a substantially constant velocity field in the vicinity of the submerged end of the tilted ramp. This constant liquid velocity field advantageously contributes to obtaining an invariable compression force within the ordered/compacted particles on the ramp and in the rest of the film floating on the carrier liquid, and this regardless of the head position relative to the receptacle and barrier means.

Preferably, the carrier liquid sucking means communicate with the carrier liquid feed means, a closed circuit integrating these two means through which the carrier liquid passes being preferentially adopted. It is noted that for the method to optimally operate, the surface tension of the carrier liquid, as well as its temperature, should preferably remain stable and even. Consequently, deionized water is preferentially used. Thus, to meet this condition, either an open circuit operation is considered by always feeding "fresh" water, or a closed circuit is adopted ensuring water filtering and purifying before reinjecting it.

Preferably, said carrier liquid and the particles are dispensed in an overflow tank provided in the head, said tank being configured such that when it overflows, the solution of carrier liquid and particles flows out onto the tilted ramp. Alternatively, the liquid and/or the particles could be directly dispensed onto the ramp, without departing from the scope of the invention. Also, the overflow tank could be only used for receiving the liquid before it flows out on the ramp, or even only for receiving the particles before they flow out on the ramp.

It is noted that a direct dispense on the ramp may not leave time to the particles to be evenly distributed over the width of the head. The overflow principle is adopted first because it allows surface fluctuations generated by the carrier liquid feed pump to "be filtered" or "attenuated", also to achieve an even laminar flow over the width of the tilted ramp, and finally to have the possibility of injecting sufficiently upstream the particles such that they have time enough to be distributed over the width of the head.

Preferably, said carrier liquid and said particles are separately dispensed in said tank. Alternatively, the liquid and particles could be previously blended before being dispensed in the tank or directly on the tilted ramp, without departing from the scope of the invention.

One object of the invention is also to provide a method for depositing a film of particles onto a substrate, comprising a step of forming a film of particles such as described above, followed by a step of transferring said film on the substrate.

According to a preferred embodiment, said transfer step is performed with the substrate horizontally orientated. In such a case, said substrate is brought into contact with said film of particles floating on the carrier liquid, by being vertically moved. To do this, said horizontal substrate is submerged in the carrier liquid during the formation of said film of particles, and then vertically raised such that this film is deposited onto this horizontal substrate, in the manner of the Langmuir-Schaefer technique. Alternatively, the vertical movement could he carried out from the outside, by moving down the substrate until it comes into contact with the film.

In this preferred embodiment, said barrier means can be an integral part of the means for vertically moving the substrate. However that may be, in this embodiment, all the particles of the compact/ordered film are simultaneously deposited onto the substrate.

According to another embodiment, said transfer step is performed with the substrate vertically or obliquely orientated. By obliquely, it is herein meant a direction tilted with respect to the vertical and horizontal directions.

In this embodiment, said transfer is performed by pulling the substrate, and moving the film onto the carrier liquid by moving said head towards said substrate. The head consequently makes a movement opposite to that operated during the film formation.

Here, said vertical or oblique substrate is rigid or flexible, previously submerged at least partly, or located outside the receptacle.

Preferably, said barrier means are formed, at least partly, by said substrate. Alternatively, additional means could be adopted to provide this temporary barrier function, these additional means being then released at the time of the film deposition.

Finally, subsequently to the transfer onto the substrate, the method preferably integrates a thermal annealing step to facilitate deposition and adhesion of these particles on the substrate.

Further advantages and characteristics of the invention will appear in the detailed non-limiting description below.

BRIEF DESCRIPTION OF THE DRAWINGS

This description will be made with regard to the appended drawings wherein.

DETAILED DESCRIPTION OF PREFERRED EMBODIMENTS

Figure 1:
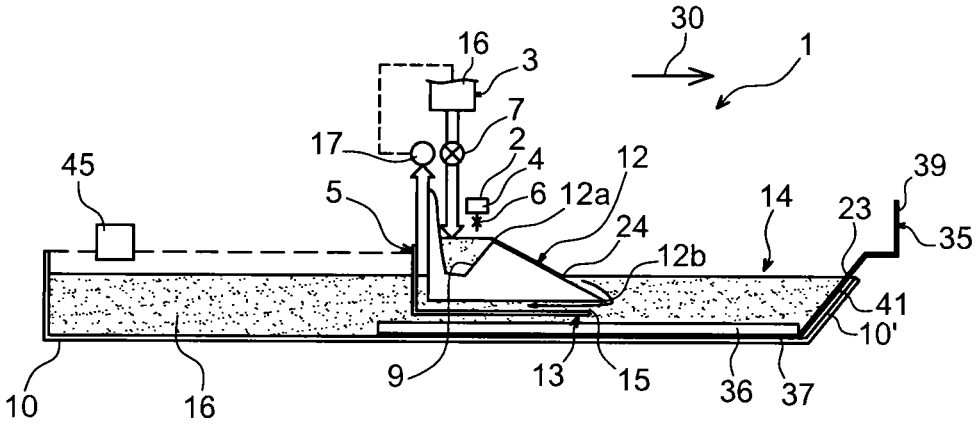
FIG. 1 shows a deposition facility according to a preferred embodiment of the present invention, in a schematic cross section view taken along line I-I of FIG. 2.
Figure 2:
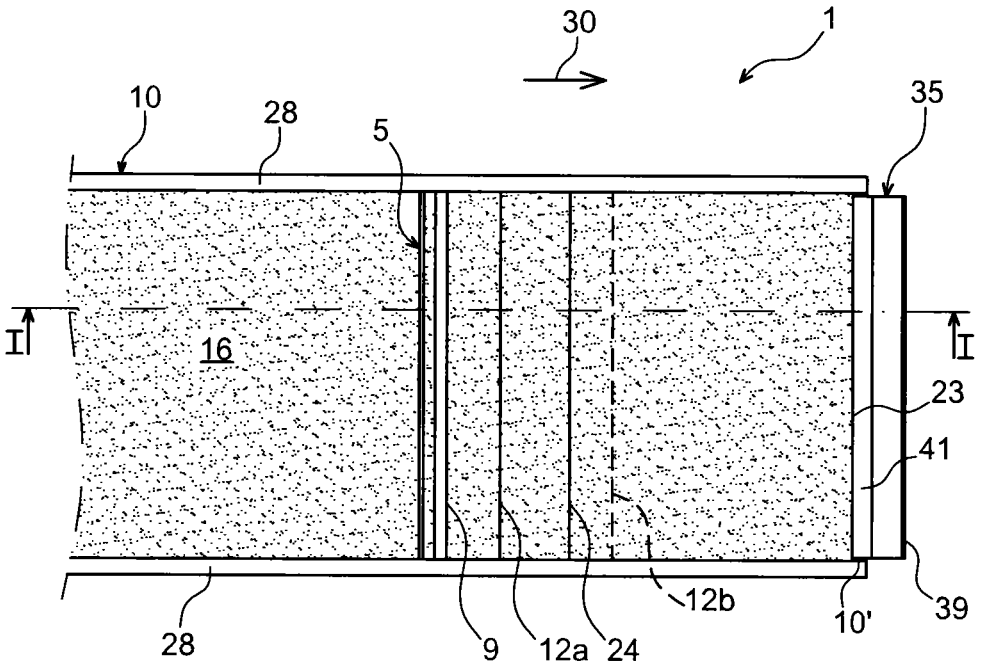
FIG. 2 represents a schematic top view of the deposition facility shown in FIG. 1.

First with reference to FIGS. 1 and 2, a facility 1 for depositing a film of particles onto a substrate, herein a horizontal substrate, is represented.

The facility 1 includes a device 2 for dispensing particles, the size of which can be between a few nanometres and a few hundreds micrometres. The particles, preferably of a spherical shape, can for example be silica particles. Other particles of interest can be made of metal or metal oxide as platinum, TiO2, polymer as polystyrene or PMMA, carbon, etc., or even any type of molecules.

More precisely, in the preferred embodiment, the particles are silica spheres having a diameter of about 1 μm, possibly stored in a solution in the dispensing device 2. The proportion of the medium is about 7 g particles for 200 mL solution, herein butanol. Naturally, for the sake of clarity, the particles represented in the figures assume a diameter higher than their actual diameter.

The dispensing device 2 has a controllable injection nozzle 6, having a diameter of about 500 μm.

Further, the facility 1 has, in the proximity of the device 2, means 3 for feeding a carrier liquid 16, which are also controllable via a valve 7 or similar.

It also includes a tub-shaped receptacle 10, having for example a rectangular parallelepiped shape, wherein the carrier liquid 16 is located.

Besides, it includes a head 5 integrating a tilted ramp 12 for flowing the particles 4 and the carrier liquid 16. The top end 12*a* of the tilted ramp bounds the aperture of an overflow tank 9 provided in the head, and wherein the particles 4 as well as the carrier liquid 16 are intended to be dispensed. Consequently, in use, when the liquid 16 overflows from the tank 9, it is discharged by the ramp 12, by driving the particles 4 previously dispensed to the surface of the same tank by the device 2.

The ramp 12 is planar, tilted by an angle between 5 and 60°, preferably between 5 and 25°, enabling the particles to be conveyed to the carrier liquid located in the tub 10, since the top end of the ramp 12 is raised relative to the liquid level in this tub. In use, in spite of the continuous liquid introduction in the tub by the means 3, via the ramp 12, the liquid level in the tub is preferentially held constant by liquid sucking means, bearing the general reference numeral 13. These means enable the liquid 16 to be sucked in the proximity of a lower end 12*b* of the ramp 12, which is submerged in the same liquid. To do this, the means 13 have a sucking hood 15 at the lower part of the head, which is connected through a channel to a pump 17, all being preferably integrated to a closed hydraulic circuit also comprising the liquid dispensing means 3 located above the overflow tank 9, and thus communicating with the sucking means 13.

The liquid 16 is thus recirculated using the aforesaid means, between the lower end of the ramp and its upper end, even if other designs can be adopted, in particular in an open circuit, without departing from the scope of the invention.

The ramp 12, dipping into the liquid 16 of the tub 10, defines with the horizontal level of this liquid an inflexion line 24, which forms an inlet for particles into the tub. This inlet is located distant from a particle barrier 23, placed in the tub 10 bounded by two side rims 28 retaining the carrier liquid 16. These rims 28, facing away from each other, extend in parallel to a main flow direction of the carrier liquid and the particles in the facility, this direction being schematized by the arrow 30 in FIGS. 1 and 2.

Between the inlet 24 and the barrier 23 at the surface of the carrier liquid, a zone 14 for building up particles is thus created, which consequently takes the shape of a substantially rectangular corridor between the side rims 28. Other geometries could however be adopted without departing from the scope of the invention.

The facility 1 is also provided with a support 35 for the substrate 36 submerged in the tub bottom. The support is equipped with a horizontal tray 37 on which rests the substrate 36, a handle 39 located outside the tub, and a zone 41 for connecting the handle and the tray. Besides, the aforesaid barrier 23 can herein be formed by the part of the connecting zone 41 passing through the surface of the liquid 16 and/or by the downstream end wall 10' of the tub 10, as will be described hereinafter.

In this first embodiment, the substrate can be rigid or flexible, because it is supported by the tray 37.

One of the features of the present invention lies herein in the fact that the head 5 is translationally moveable relative to the tub 10, along the direction 30, that is in parallel to the surface of the carrier liquid. To do this, conventional translation means 45 can be adopted (only schematically represented), for example driven by a rectilinear motion linear engine. The head 5, equipped with its means 2, 3, is thus movable at the surface of the carrier liquid, so as to be able to be moved away from/closer to the barrier 23.

A method for depositing particles according to a first embodiment will now be described with reference to FIGS. 3*a* to 3*f*.

Figure 3A:
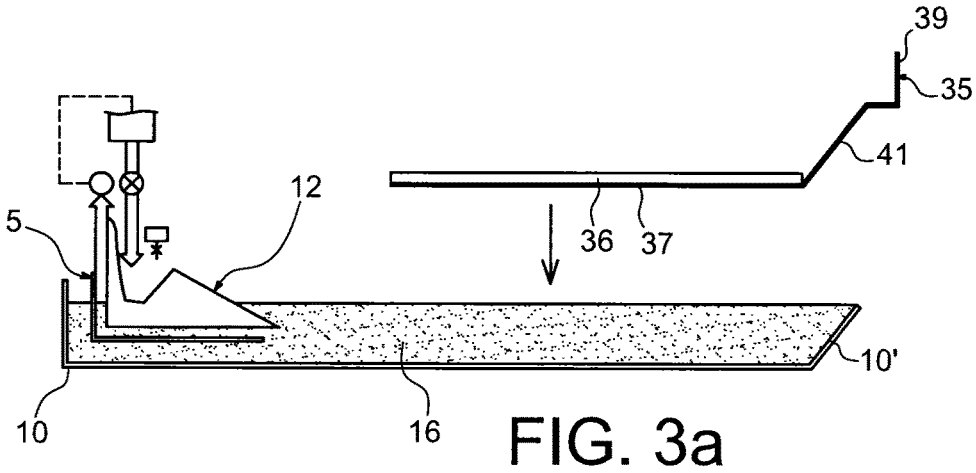
FIGS. 3*a* to 3*f* represent different steps of a deposition method implemented using the facility shown in the preceding figures, according to a first preferred embodiment.
Figure 3B:
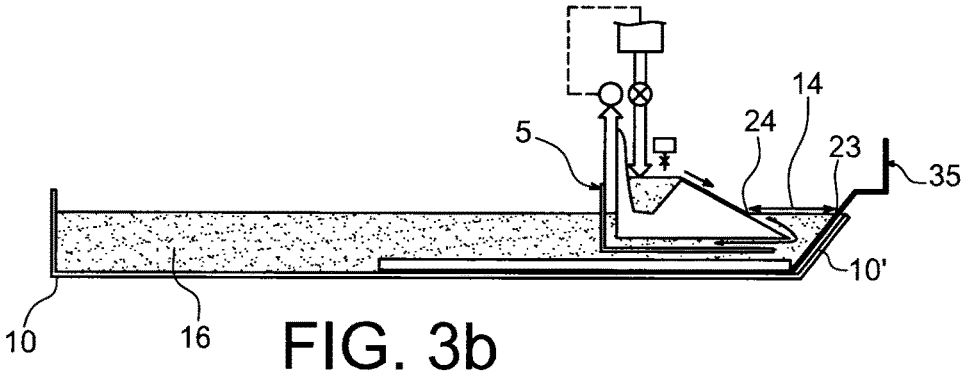

First, the head 5 is sufficiently set back to enable the substrate 36 carried by the support tray 35 to be submerged, as schematized in FIG. 3*a*. Then, the head is moved in the other direction in order to move closer to the barrier 23. As shown in FIG. 3*b*, the building up zone 14 between this barrier and the inflection line 24 is then very reduced, so as to be able to make the blank of a film of particles.

To do this, the injection nozzle 6 is activated for the purpose of starting dispensing the particles 4 into the tank, as well as, beforehand, the means for sucking the liquid 13 and feeding the liquid 3 are also activated. The flow rates of the means 13 and 3 are preferably held constant for the entire duration of dispensing the particles, in order to achieve constant film formation conditions, regardless on the other hand the position of the head during the formation of this film.

For the step of making the film blank in the reduced building up zone 14, the object is simply to fill this zone 14 with particles 4 floating on the carrier liquid.

Figure 3C:
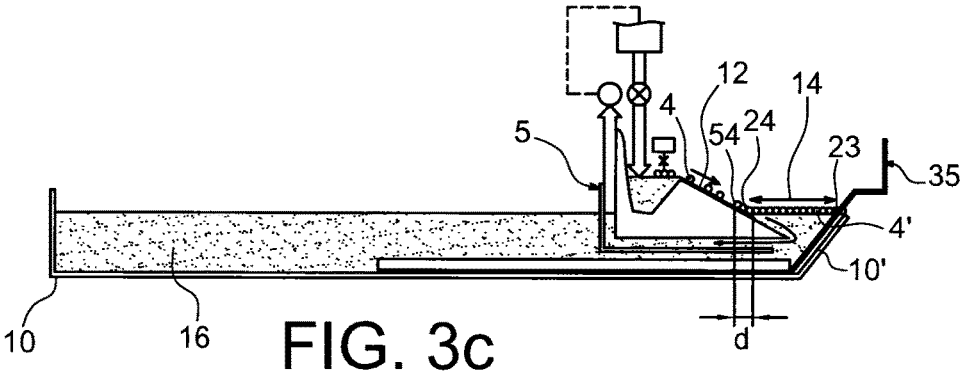
Figure 3D:
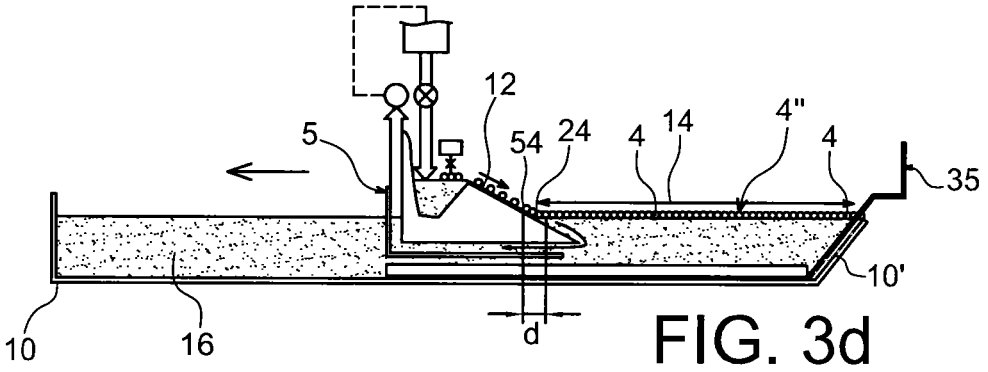

During this phase, the particles 4 overflowing from the tank flow on the ramp 12, and then penetrate the zone 14 wherein they are dispersed. As these particles 4 penetrate the zone 14, they abut against the barrier 23, and then the upstream front of these particles tends to shift upstream, towards the inflection line 24. The injection of particles continues even after this upstream front goes over the line 24, so that it rises on the tilted ramp 12, as shown in FIG. 3*c*.

Actually, the upstream front of particles 54 is such that it can rise onto the ramp 12 such that it is located at a given horizontal distance "d" from the inflection line 24, wherein this distance "d" can be in the order of 15 mm.

At this time, the particles 4 forming the blank are ordered/compacted in the reduced zone 14 and on the ramp 12, wherein they are automatically ordered/compacted, without assistance, thanks in particular to their kinetic energy and to the capillary forces exploited at the time of the impact onto the front 54. In the case of spherical particles as presented in this embodiment, the ordering is such that the compact film blank obtained has a so-called "hexagonal compact" structure, wherein each particle 4 is surrounded and contacted by six other particles 4 in contact with each other. This is then indiscriminately referred to as a compact film of particles, or film of ordered particles, the later terminology being preferentially adopted in the case of spherical particles.

Once the ordered particles 4 forming the film blank 4' cover the entire carrier liquid located in the reduced building up zone 14, a new step is started, aiming at elongating the film length.

Figure 3E:
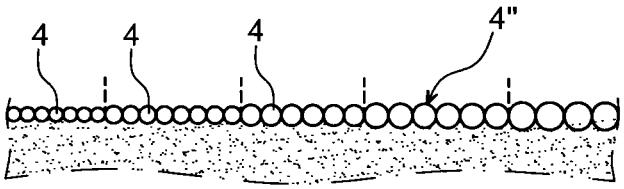

This elongating step is implemented by continuing the liquid sucking and feeding, as well as the particle dispense. On the other hand, the head 5 is set back so as to move away from the barrier 23, in order to elongate the building up zone 14 wherein the film 4" of particles 4 is formed. This movement is performed at a rate which enables the front of particles 54 to be kept on the ramp 12, preferably in a constant position, as schematized in FIG. 3*d*. Consequently, the film 4" is gradually elongated as the head 5 sets back relative to the tank 10, while holding the ordering of the particles 4 already deposited onto the ramp 12 and into the zone 14. This principle of elongating the film to upstream, in the reverse direction of the particles dispense, enables substantially constant film formation conditions to be kept, making the quality thereof independent of its length. The film 4" can be formed on a great length, being close to the total length of the tank, and thus allows high quality depositions on large areas. Besides, as schematically shown in FIG. 3*e*, a heterogeneous film 4" can be controllably obtained, since when new particles 4 pass through the ramp 12, they directly reach the upstream front 54 on which they adopt an ordering which is kept throughout the film formation. Then, it is simply sufficient to dispense particles 4 of different natures in turn, for example of different sizes as schematized in FIG. 3*e*, which then are found in the film 4" in an order corresponding to that wherein they have been dispensed.

For that purpose, it is possible to position several particle injectors in order to actuate the one desired at the desired time. It is also possible to divide the ramp into sections, each section being separated from the other by one or two walls parallel to the edges, and to associate one or more injectors to each section. It is also possible to make a gradient in the movement direction of the head but also in the direction perpendicular to this movement.

Figure 3F:
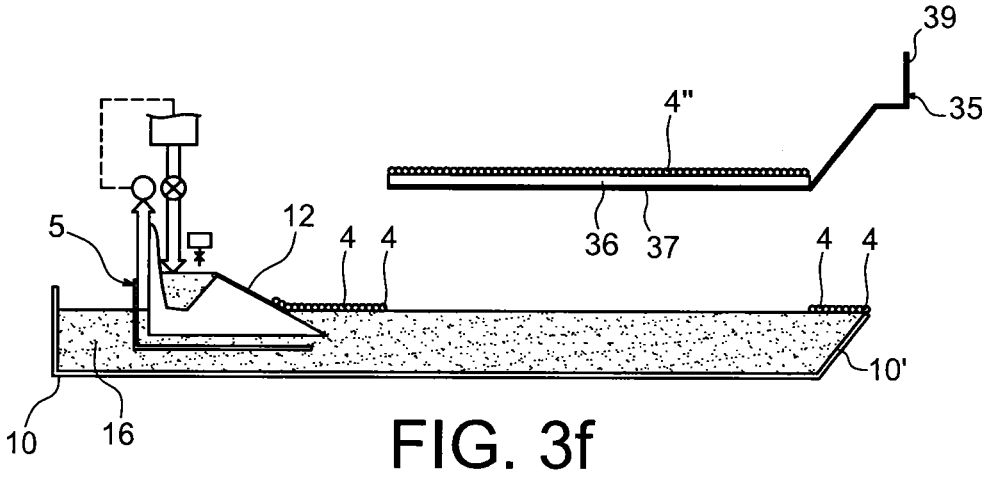

Once the film 4" is elongated to the desired length, still held by the tilted ramp 12 of the head at shutdown, this film is transferred onto the substrate 36 according to a technique analogous to that of Langmuir-Schaefer. A schematic representation of this step is shown in FIG. 3*f*. It consists in vertically moving the substrate 36 using the handle 39 of the support 35, in a manual or automated manner. Being horizontally held during this movement, when the substrate 36 comes into contact with the particles of the film 4", the latter is deposited onto the upper surface of the substrate. The excess of particles 4 remaining on the carrier liquid can then be moved so as to form all or part of the blank of a next film to be deposited. Alternatively, the excess can be sucked in.

It is besides noted that the barrier 23 can possibly be formed not only by the support 35, but also in combination with the downstream end wall 10' of the tank, when the junction zone 41 has a width lower than the total width of the tank between both side rims. In such a case, after the film 4" is deposited onto the substrate, particles 4 remain on either side of the film carried away on the same substrate 36, as shown in FIG. 3*f*. Another solution consists in making this barrier such that it is integrally formed by this downstream end wall 10' of the tank facing the ramp 12. In such a case, the connecting zone 41 is then preferably located close to either one of the side rims 28.

To facilitate deposition and adhesion of the particles 4 onto the substrate 36, preferably made of a polymer, a thermal annealing is provided subsequently to the transfer. This thermal annealing is for example made at 80° C., using a polyester based low temperature matte laminating film, for example marketed as PERFEX-MATT™, having a 125 μm thickness.

The advantage of such a film as a substrate is that one of its faces becomes sticky at the temperature in the order of 80° C., which enables adhesion of the particles 4 to be facilitated. Alternatively, the substrate 36 can be of the silicon, glass or even piezoelectric film type.

As discussed above, during the film elongation, the injection of particles/liquid and the movement rate of the head are adjusted such that the front of particles 54 remains in a substantially identical position. For this, the flow rate of particles can be in the order of 0.01 mL/min to 10 mL/min, whereas the linear rate of the head 5 can be in the order of a few mm/min to 30 cm/min. The flow rate of carrier liquid is in turn set between 100 and 1000 mL/min.

Figure 4A:
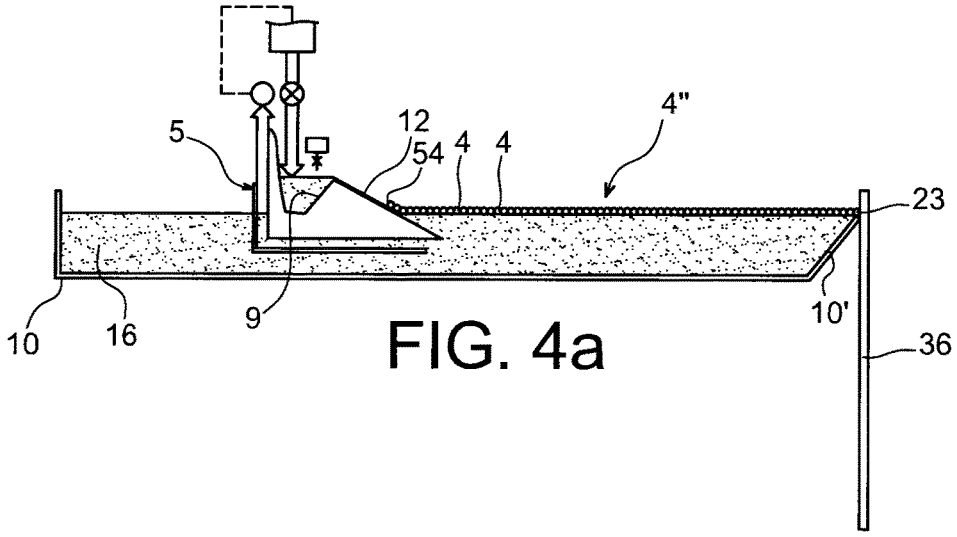
FIGS. 4*a* and 4*b* schematize a deposition method according to a second preferred embodiment.
Figure 4B:
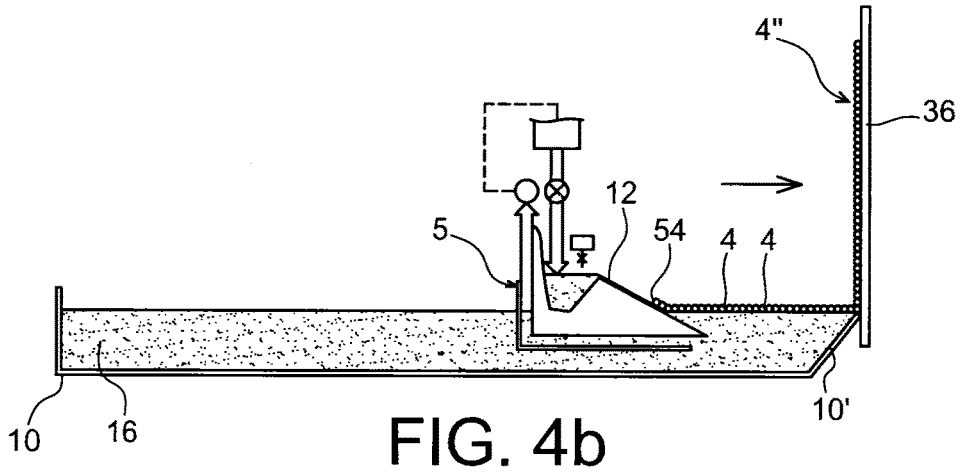
Figure 5:
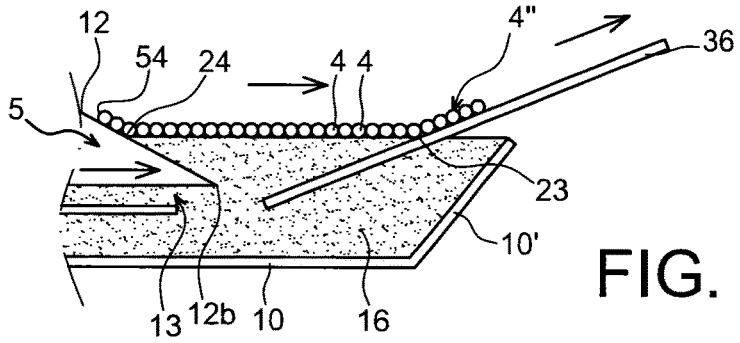
FIG. 5 schematizes a deposition method according to a third preferred embodiment.

FIGS. 4*a* and 4*b* schematize a second preferred embodiment, wherein the film transfer is performed on a vertically orientated substrate 36. The formation of the film 4" of ordered particles 4 onto the carrier liquid 16 is performed in an identical or analogous manner to that presented within the scope of the first embodiment, with the barrier 23 herein consisting of a part of the substrate 36 is located at the periphery of the tub, as shown in FIG. 4*a*. The particles are thus in direct contact with this substrate. Then, for the transfer, the substrate is vertically moved at the same time as the film 4" is pushed by the head 5 moving in the opposite direction to the one that enabled the film elongation. A conventional pulling is then achieved, as schematized in FIG. 4*b*. This embodiment could be implemented with the substrate 36 previously partly submerged in the carrier liquid, without departing from the scope of the invention. Besides, this is the solution preferentially adopted for the third embodiment shown in FIG. 5, wherein the substrate 36 previously partly submerged, is obliquely arranged, that is tilted with respect to the vertical and horizontal directions. For pulling, the substrate 36 is preferentially moved in the plane wherein it lies during the previous step of forming the film, during which its part passing through the carrier liquid acts as the barrier 23.

For the second and third embodiments, the substrate 36 is preferentially rigid, but could be replaced by a flexible substrate in the form of a moving strip, passing through rolls or the like.

Possible applications for the methods just described have been mentioned above. Concrete examples are also described below.

These are for example heat exchangers. The structuration of the walls of exchangers is a means to adjust the heat exchanges. These structurations can be made by lithography with a mask of particles. With the methods described above, the implementation of heterogeneous depositions associating particles of different dimensions makes possible to obtain geometries usually made by lithography, and in particular geometries with gradients of particle sizes. It is thus possible, with this technique, to form surfaces with energy gradients, for example to promote formation and flow of surface condensed drops.

Another example relates to the field of tribology. For mechanical applications, compact films can be used as a lithography mask to create micro/nanovessels enabling the lubricant to be retained at the surface of rubbing objects. The adjustment of the dimensions of these retention micro/nanovessels is a parameter for adjusting the friction coefficient. A simple means to change the dimensions of these micro/nanovessels is to use as an etching mask a heterogeneous compact film comprised of different particle sizes, easy to be obtained with the method specific to the present invention.

Of course, various modifications can be provided by those skilled in the art to the invention just described, only by way of non-limiting examples.

The invention claimed is:

1. A method for forming a film of particles on a carrier liquid present in a receptacle, for depositing this film onto a substrate, the method comprising:

making a film blank between barrier means and a head including a tilted ramp, the blank being obtained by dispensing particles via the tilted ramp, carried out until the particles floating on the carrier liquid occupy a space between the barrier means against which they abut, and an upstream front of particles located on the tilted ramp; and elongating the film while simultaneously continuing dispensing the particles via the tilted ramp, and moving the head relative to the receptacle to move the head away from the barrier means, this film elongation being performed to hold the upstream front of particles on the tilted ramp.

2. The method according to claim 1, wherein during the elongating the film, the upstream front of particles is held in a same position on the tilted ramp.

3. The method according to claim 1, wherein the head includes sucking means for sucking part of the carrier liquid in proximity of a submerged end of the tilted ramp, the sucking means being activated at least during part of the elongating the film.

4. The method according to claim 1, wherein carrier liquid feed means supplies the head with the carrier liquid such that the same drives the particles onto the tilted ramp.

5. The method according to claim 3, wherein carrier liquid feed means supplies the head with the carrier liquid such that the same drives the particles onto the tilted ramp, and wherein the sucking means communicates with the carrier liquid feed means.

6. The method according to claim 4, wherein the carrier liquid and the particles are dispensed in an overflow tank provided in the head, the tank being configured such that when the tank overflows, a solution of carrier liquid and particles flows out on the tilted ramp.

7. The method according to claim 6, wherein the carrier liquid and the particles are dispensed separately in the tank.

8. A method for depositing a film of particles onto a substrate, comprising a method of forming a film of ordered particles according to claim 1, followed by transferring the film onto the substrate.

9. The method according to claim 8, wherein the transferring is performed with the substrate horizontally orientated.

10. The method according to claim 9, wherein the substrate is brought in contact with the film of particles floating on the carrier liquid, by being vertically moved.

11. The method according to claim 10, wherein the horizontal substrate is submerged in the carrier liquid during formation of the film of particles, and then vertically raised such that the film is deposited onto the horizontal substrate.

12. The method according to claim 8, wherein the transfer is performed with the substrate vertically or obliquely orientated.

13. The method according to claim 12, wherein the transfer is performed by pulling the substrate, and moving the film on the carrier liquid by moving the head towards the substrate.

14. The method according to claim 12, wherein the vertical or oblique substrate is rigid or flexible.

15. The method according to claim 12, wherein the barrier means is formed by the substrate.

* * * * *